US009623583B2

(12) United States Patent
Sinzig et al.

(10) Patent No.: US 9,623,583 B2
(45) Date of Patent: Apr. 18, 2017

(54) DEVICE FOR LIMITING THE DEPTH OF A CUT

(71) Applicant: Robert Bosch GmbH, Stuttgart (DE)

(72) Inventors: Bruno Sinzig, Oberbipp (CH); Laurent Gribi, Büren an der Aare (CH)

(73) Assignee: Robert Bosch GmbH, Stuttgart (DE)

( * ) Notice: Subject to any disclaimer, the term of this patent is extended or adjusted under 35 U.S.C. 154(b) by 351 days.

(21) Appl. No.: 14/355,791

(22) PCT Filed: Sep. 20, 2012

(86) PCT No.: PCT/EP2012/068477
§ 371 (c)(1),
(2) Date: May 1, 2014

(87) PCT Pub. No.: WO2013/072106
PCT Pub. Date: May 23, 2013

(65) Prior Publication Data

US 2014/0283396 A1 Sep. 25, 2014

(30) Foreign Application Priority Data

Nov. 15, 2011 (DE) ..... 10 2011 086 337

(51) Int. Cl.
*B27B 21/08* (2006.01)
*B27G 19/04* (2006.01)
*B27B 9/02* (2006.01)

(52) U.S. Cl.
CPC ..... *B27B 21/08* (2013.01); *B27B 9/02* (2013.01); *B27G 19/04* (2013.01)

(58) Field of Classification Search
CPC B27B 21/08; B27B 9/02; B27B 21/00; B27B 9/00
(Continued)

(56) References Cited

U.S. PATENT DOCUMENTS 2,488,947 A * 11/1949 Vavrik ..... B23D 59/002 29/DIG. 60
2,543,486 A * 2/1951 Briskin ..... B23D 57/0076 30/376
(Continued)

FOREIGN PATENT DOCUMENTS

CN 1519089 A 8/2004
CN 1910020 A 2/2007
(Continued)

OTHER PUBLICATIONS

International Search Report corresponding to PCT Application No. PCT/EP2012/068477, mailed Feb. 8, 2013 (German and English language document) (5 pages).

*Primary Examiner* — Jason Daniel Prone
*Assistant Examiner* — Richard Crosby, Jr.
(74) *Attorney, Agent, or Firm* — Maginot, Moore & Beck LLP

(57) ABSTRACT

A device for limiting the depth of a cut, which is to be used in portable machine tools, includes at least one cut-depth guide unit, and at least one stop unit that has at least one stop element. The stop element has, for the purpose of limiting the depth of a cut, a movement potential relative to the cut-depth guide unit along a cut-depth guide track of the cut-depth guide unit. The cut-depth limiting device further includes at least one stop movement unit which is configured to allow the stop element a further movement potential relative to the cut-depth guide unit, at least one of along and about an axis of movement, at least when in a state of operation.

10 Claims, 6 Drawing Sheets

(58) Field of Classification Search
USPC ..... 30/370–378, 388–391
See application file for complete search history.

(56) References Cited

U.S. PATENT DOCUMENTS

| | | | | | |
|---|---|---|---|---|---|
| 3,262,472 | A * | 7/1966 | McCarty | B27B 9/02 | 30/295 |
| 5,010,651 | A * | 4/1991 | Techter | B27B 9/02 | 144/136.1 |
| 5,136,910 | A * | 8/1992 | Kuhn | B23D 59/002 | 144/136.1 |
| 5,235,752 | A * | 8/1993 | Sauerwein | B27G 19/08 | 30/377 |
| 5,517,763 | A | 5/1996 | Schilling et al. | | |
| 5,570,511 | A * | 11/1996 | Reich | B27B 9/02 | 30/376 |
| 5,676,126 | A * | 10/1997 | Rupprecht | B27B 9/02 | 125/13.01 |
| 6,202,311 | B1 * | 3/2001 | Nickels, Jr. | B27B 9/02 | 30/376 |
| 6,601,305 | B1 * | 8/2003 | Fukuoka | B27B 9/02 | 30/376 |
| 6,691,418 | B1 * | 2/2004 | Lewin | B27B 9/02 | 30/375 |
| 6,886,259 | B2 * | 5/2005 | Kani | B27B 9/02 | 30/376 |
| 6,951,057 | B2 * | 10/2005 | Yoshida | B27B 9/02 | 30/376 |
| 7,055,250 | B2 * | 6/2006 | Allemann | B23D 57/023 | 30/374 |
| 7,300,339 | B2 * | 11/2007 | Gaul | B24B 55/052 | 451/358 |
| 7,866,051 | B2 * | 1/2011 | Niwa | B27B 9/02 | 30/376 |
| 7,975,388 | B2 * | 7/2011 | Fuchs | B27B 9/00 | 30/377 |
| 8,056,243 | B2 * | 11/2011 | Sargeant | B27B 9/02 | 144/136.95 |
| 8,640,346 | B2 * | 2/2014 | Allen | B27B 9/02 | 30/376 |
| 2005/0217124 | A1 | 10/2005 | Fuchs et al. | | |
| 2014/0283396 | A1 * | 9/2014 | Sinzig | B27G 19/04 | 30/505 |

FOREIGN PATENT DOCUMENTS

| | | | |
|---|---|---|---|
| CN | 102601449 | A | 7/2012 |
| EP | 0 734 822 | A2 | 2/1996 |
| EP | 1 777 047 | A1 | 4/2007 |
| JP | 2000-15603 | A | 1/2000 |
| JP | 2007-223133 | A | 9/2007 |
| RU | 2 095 203 | C1 | 11/1997 |
| RU | 91 689 | U1 | 2/2010 |
| SU | 280809 | A1 | 1/1970 |

* cited by examiner

DEVICE FOR LIMITING THE DEPTH OF A CUT

This application is a 35 U.S.C. §371 National Stage Application of PCT/EP2012/068477, filed on Sep. 20, 2012, which claims the benefit of priority to Serial No. DE 10 2011 086 337.0, filed on Nov. 15, 2011 in Germany, the disclosures of which are incorporated herein by reference in their entirety.

BACKGROUND

There are already known cut-depth limiting devices for portable power tools, which comprise a cut-depth guide unit and a stop unit, the latter having a stop element that, for the purpose of limiting a depth of cut, has a capability to move relative to the cut-depth guide unit along a cut-depth guide path of the cut-depth guide unit.

SUMMARY

The disclosure is based on a cut-depth limiting device for portable power tools, comprising at least one cut-depth guide unit, and comprising at least one stop unit, which has at least one stop element that, for the purpose of limiting a depth of cut, has a capability to move relative to the cut-depth guide unit along a cut-depth guide path of the cut-depth guide unit.

It is proposed that the cut-depth limiting device have at least one stop movement unit, which is provided to allow a further capability of the stop element to move relative to the cut-depth guide unit along and/or about a movement axis, at least when in an operating state. The expression "cut-depth limiting device" is intended here to define, in particular, a device provided to limit a distance to which a working tool, in particular a circular-saw blade connected to a tool receiver of a portable power tool is inserted into a workpiece on which work is to be performed, and/or to set a length of the insertion distance, in particular by means of the stop unit. "Provided" is to be understood to mean, in particular, specially designed and/or specially equipped. In this case, the depth to which the working tool is inserted in a workpiece on which work is to be performed is, in particular, that viewed along a direction running substantially perpendicularly in relation to a seating surface of a seating unit of the portable power tool, by which the portable power tool is seated on a workpiece surface of a workpiece on which work is to be performed. The expression "substantially perpendicularly" is intended here to define, in particular, an alignment of a direction relative to a reference direction, the direction and the reference direction, in particular as viewed in one plane, enclosing an angle of 90° and the angle having a maximum deviation of, in particular, less than 8°, advantageously less than 5°, and particularly advantageously less than 2°.

Preferably, the stop unit is used to limit a movement distance of the tool receiver in the direction of the seating unit, relative to the seating unit, and/or to set a length of the movement distance of the tool receiver in the direction of the seating unit, relative to the seating unit. Preferably, a length of the movement distance of the tool receiver in the direction of the seating unit, relative to the seating unit, can be set by means of setting a position of the stop element relative to the cut-depth guide unit. Preferably, a depth of cut of a working tool, which goes into a workpiece surface when work is being performed on a workpiece, can be set by means of setting a length of the movement distance of the tool receiver, in particular with a working tool attached thereto, relative to the seating unit. A "seating unit" is to be understood here to mean, in particular, a unit that, while work is being performed on a workpiece by means of the portable power tool, the portable power tool being handled in the correct manner, is seated on the workpiece, in particular with a seating surface of the seating unit, and which is provided to support the portable power tool on the workpiece while work is being performed on the workpiece. Particularly preferably, the seating unit is realized as a slide pad and/or as a base plate.

The expression "movably mounted" is to be understood here to mean, in particular, a mounting of the stop element on the cut-depth guide unit, wherein the stop element, in particular in isolation from an elastic deformation of the stop element, has a capability to move relative to the cut-depth guide element, along at least one axis along a distance greater than 1 mm, preferably greater than 10 mm, and particularly preferably greater than 20 mm. Alternatively or additionally, however, it is also conceivable for the stop element to have a different movement capability, in particular relative to the cut-depth guide unit, considered appropriate by persons skilled in the art, such as, for example, a capability to move about least one axis, by an angle greater than 10°, preferably greater than 20°, and particularly preferably greater than 30°. The expression "cut-depth guide unit" is intended here to define, in particular, a unit provided to guide a component, during a movement along a predefined path, transversely in relation to a movement direction by means of an action of at least one constraining force. A "constraining force" is to be understood here to mean, in particular, a force provided to prevent a component from moving in at least one direction and/or to keep the component, during a movement, on a path defined by action of the force upon the component.

The term "stop movement unit" is intended here to define, in particular, a unit provided to allow, in addition to a capability of the stop element to move along the cut-depth guide path, a further capability of the stop element to move along and/or about a movement axis, relative to the cut-depth guide unit, in at least one operating state. Preferably, the movement axis of the stop element runs at least substantially parallelwise or at least substantially transversely in relation to the cut-depth guide path. "Substantially parallelwise" is intended here to mean, in particular, an alignment of a direction relative to a reference direction, in particular in one plane, wherein the direction deviates from the reference direction by, in particular, less than 8°, advantageously less than 5°, and particularly advantageously less than 2° and, in particular, is identical with reference direction. The expression "at least substantially transversely" is intended here to define, in particular, an alignment of a direction relative to a reference direction, wherein the direction and the reference direction, in particular as viewed in one plane, have mutually differing courses and, in particular, also differ from each other from purely opposite courses of the direction and reference direction. The movement axis can thus run along the cut-depth guide path or have a course that differs from a course of the cut-depth guide course. Preferably, the movement axis is realized as a pivot axis, about which the stop element is mounted so as to be movable relative to the cut-depth guide unit. It is also conceivable, however, for the stop movement unit to be provided to move the stop element along a movement axis running parallelwise in relation to the cut-depth guide path, in at least one state in which a cut-depth guide element of the cut-depth guide unit is fixed relative to a guide rail element of the cut-depth guide unit.

Preferably, owing to the further movement capability of the stop element, a stop surface of the stop element is moved by the stop movement unit along at least one distance, in at least one operating position, wherein at least one characteristic quantity of the distance such as, for example, a length of the distance and/or a radius of the distance, etc. corresponds to a dimension, in particular a height, of a constraining guide unit coupled to the portable power tool. The design of the cut-depth limiting device according to the disclosure thus makes it possible, advantageously, to achieve a setting of the stop element to take account of a further relevant parameter such as, for example, a height of a constraining guide unit, when a limitation of a depth of cut is being set, wherein, advantageously, a setting to take account of the parameter, in isolation from a setting of a limitation of the depth of cut, can be effected by means of a movement of the stop element, relative to the cut-depth guide unit, along the cut-depth guide path. Advantageously, therefore, for example in the case of a portable power tool, in particular a circular saw, a setting of a limitation of a depth of cut can be effected by means of a movement of the stop element, relative to the cut-depth guide unit, along the cut-depth guide path, and then, with the use of a constraining guide unit, in particular a guide rail that can be connected to the portable power tool in a form-closed manner, a height of the constraining guide unit can be taken into account, owing to the further movement capability of the stop element, wherein a previously set limitation of a depth of cut can be retained, advantageously, and a readjustment such as, for example, an alteration of a position of a display element and an adaptation of a position of the stop element along the cut-depth guide path, to take account of a height of a constraining guide unit, for the purpose of setting a limitation of a depth of cut, can be avoided. Advantageously, a high degree of operating comfort can thus be achieved.

Furthermore, it is proposed that the cut-depth guide unit comprise at least one cut-depth guide element, which is mounted so as to be movable relative to a guide rail element of the cut-depth guide unit and on which the stop element is mounted so as to be movable relative to the cut-depth guide element. The stop element in this case can be mounted in a pivotable and/or translationally movable manner on the cut-depth guide element, in order to achieve a further movement capability of the stop element. A "cut-depth guide element" is to be understood here to mean, in particular, an element that can be moved relative to the guide rail element, directly or indirectly by means of a form-closure connection to a form-closure region of the guide-rail element, at least substantially transversely in relation to a guide path, running form-closure direction, in particular the cut-depth guide path. The cut-depth guide element preferably has at least one latching element, which is integrally formed on to the cut-depth guide element and which is provided to fix the cut-depth guide element in at least one position relative to the guide rail element by acting in combination with latching recesses or with counter-latching element of the guide rail element. "Integrally" is to be understood to mean, in particular, connected in a materially bonded manner such as, for example, by a welding process and/or an adhesive bonding process etc. and, particularly advantageously, by being formed-on, such as, for example, by being produced from a casting and/or by being produced in a single- or multi-component injection process. It is also conceivable, however, for the cut-depth guide element to have at least one latching recess that, by acting in combination with latching elements integrally formed on to the guide rail element, enables the cut-depth guide element to be fixed in at least one position relative to the guide rail element. Owing to the design of the cut-depth limiting device according to the disclosure, a further capability of the stop element to move relative to the cut-depth guide unit can be achieved through simple design means.

Advantageously, the stop movement unit has at least one position fixing element, which is provided to fix the stop element in a position relative to the cut-depth guide element. Preferably, the position fixing element is realized as a spring-biased latching pin. Preferably, the position fixing element, realized as a spring-biased latching pin, engages in a position fixing recess of the cut-depth guide element for the purpose of fixing a position of the stop element relative to the cut-depth guide element. It is also conceivable, however, for the position fixing element to be of a different design, considered appropriate by persons skilled in the art, such as, for example, designed as a clamping element, etc. Advantageously, the stop element can be secured in a position relative to the cut-depth guide element in order, advantageously, to avoid an unintentional movement of the stop element relative to the cut-depth guide element.

It is additionally proposed that the cut-depth guide unit have at least one further cut-depth guide element, which is mounted so as to be movable relative to a guide rail element of the cut-depth guide unit and on which the cut-depth guide element is movably mounted. Preferably, the further cut-depth guide element is realized as a guide block. Preferably, the cut-depth guide element, realized as a guide block, has an indicator element. The indicator element is preferably provided to indicate to an operator, by means of a scale disposed on the guide rail element, a limitation of a depth of cut set by means of the cut-depth limiting device. It is also conceivable, however, for the indicator element to be realized as a digital display, by means of which a set limitation of a depth of cut can be represented. In this case, the cut-depth guide element is preferably pivotally mounted on the further cut-depth guide element. It is also conceivable, however, for the cut-depth guide element to be mounted in a translationally movable manner on the further cut-depth guide element. Owing to the design of the cut-depth limiting device according to the disclosure, guidance of the stop element, for the purpose of setting a limitation of a depth of cut and, in addition, a capability to lock the stop element relative to the guide rail element, for the purpose of limiting the depth of cut, can be achieved through simple design means.

Moreover, it is proposed that the cut-depth guide unit have at least one spring element, which is provided to apply a spring force to the cut-depth guide element in the direction of the guide rail element. A "spring element" is to be understood to mean, in particular, a macroscopic element having at least one extent that, in a normal operating state, can be varied elastically by at least 10%, in particular by at least 20%, preferably by at least 30%, and particularly advantageously by at least 50% and that, in particular, generates a counter-force, which is dependent on the variation of the extent and preferably proportional to the variation and which counteracts the variation. An "extent" of an element is to be understood to mean, in particular, a maximum distance of two points of a perpendicular projection of the element on to a plane. A "macroscopic element" is to be understood to mean, in particular, an element having an extent of at least 1 mm, in particular of at least 5 mm, and preferably of at least 10 mm. Preferably, the spring element is realized as a compression spring. It is also conceivable, however, for the spring element to be of different design, considered appropriate by persons skilled in the art. By means of the spring element it is possible to achieve, in particular, automatic latching of the latching element into corresponding latching recesses of the guide rail element, this being advantageous if the cut-depth guide element is designed so as to be integral with at least one latching element.

Furthermore, it is proposed that the stop movement unit have at least one stop movement element, realized as an operating lever, which is mounted on a cut-depth guide element of the cut-depth guide unit so as to be pivotable about the movement axis. It is also conceivable, however, for the stop movement element to be of a different design, considered appropriate by persons skilled in the art, such as, for example, designed as a pushbutton, as a slide, etc. Preferably, the stop movement element is movably mounted on the cut-depth guide element realized with at least one integrally formed-on latching element. This makes it possible, advantageously, to achieve comfortable operation of the stop movement unit, for the purpose of moving the stop element.

Advantageously, the stop element and the stop movement element are fixedly connected to each other. In this case, the stop element and the stop movement element can be connected to each other by means of a form-closure, force-closure and/or materially bonded connection. Preferably, the stop element and the stop movement element are fixedly connected to each other by means of a screwed connection. "Fixedly connected to each other" is to be understood here to mean, in particular, a connection between at least two components, by means of which a movement of one of the components is directly transmitted to the other component, in particular in isolation from interposed components, with the exception of connecting elements. It is also conceivable, however, for the stop element and the stop movement element to be connected to each other in a motionally dependent manner via an interposed unit such as, for example, a transmission, or a lever mechanism, etc. Preferably, the stop element and the stop movement element are offset relative to each other by approximately 180°. By simple design means, a movement of the stop movement element can be transmitted to the stop element. Particularly if a screwed connection is used, an inexpensive variant can be achieved for the transmission of movement between the stop element and the stop movement element.

Furthermore, it is proposed that the movement axis of the stop element run at least substantially perpendicularly in relation to a course of the cut-depth guide path. It is also conceivable, however, for the movement axis of the stop element to run at least substantially parallelwise in relation to the cut-depth guide path. Advantageously, a compact arrangement of the stop element can be achieved.

Advantageously, the stop element is mounted on the cut-depth guide element so as to be pivotable about the movement axis. Preferably, the stop element is mounted on the cut-depth guide element so as to be pivotable relative to the cut-depth guide element. It is also conceivable, however, for the stop element to be mounted on the cut-depth guide element so as to be translationally movable relative to the cut-depth guide element. The fact that the stop element is pivotally mounted makes it possible, advantageously, to achieve a mounting of the stop element that is not susceptible to dirt. Thus, advantageously, a robust stop movement unit can be realized.

The disclosure is additionally based on a portable power tool, in particular a circular saw, comprising a cut-depth limiting device according to the disclosure. A "portable power tool" is to be understood here to mean, in particular, a power tool, for performing work on workpieces, that can be transported by an operator without the use of a transport machine. The portable power tool has, in particular, a mass of less than 40 kg, preferably less than 10 kg, and particularly preferably less than 5 kg. Particularly preferably, the portable power tool is realized as plunge-cut circular saw. It is also conceivable, however, for the portable power tool to be of a different design, considered appropriate by persons skilled in the art, such as, for example, designed as a plunge-cut saw, as an electric handsaw, etc. Advantageously, a high degree of operating comfort can be achieved for an operator of the portable power tool.

The cut-depth limiting device according to the disclosure and/or the portable power tool according to the disclosure are/is not intended in this case to be limited to the application and embodiment described above. In particular, the cut-depth limiting device according to the disclosure and/or the portable power tool according to the disclosure may have individual elements, components and units that differ in number from a number stated herein, in order to fulfill a principle of function described herein.

BRIEF DESCRIPTION OF THE DRAWINGS

Further advantages are given by the following description of the drawing. The drawing shows an exemplary embodiment of the disclosure. The drawing, the description and the claims contain numerous features in combination. Persons skilled in the art will also expediently consider the features individually and combine them to create appropriate further combinations.

In the drawing.

DETAILED DESCRIPTION

Figure 1:
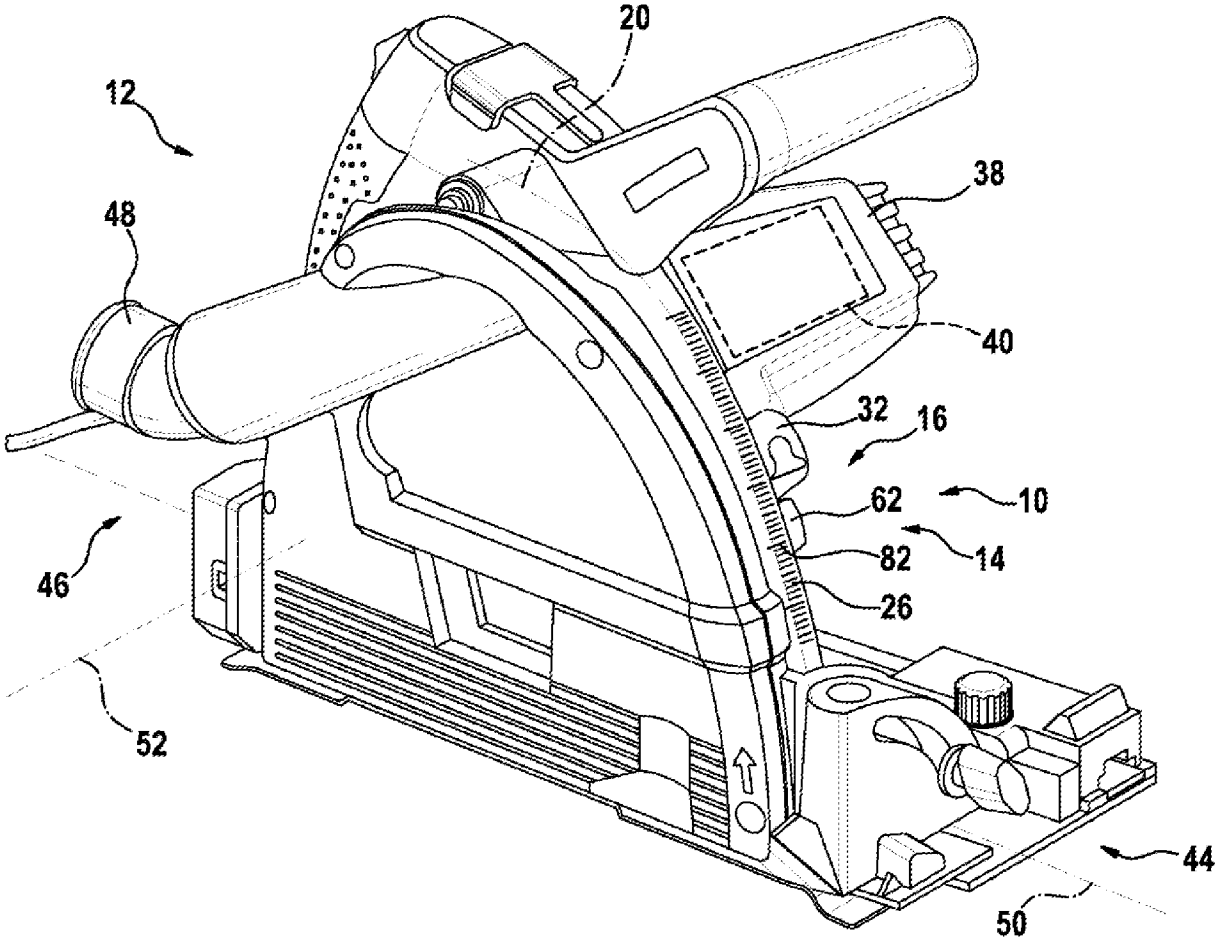
FIG. 1 shows a schematic representation of a portable power tool according to the disclosure, having a cut-depth limiting device according to the disclosure.
Figure 3A:
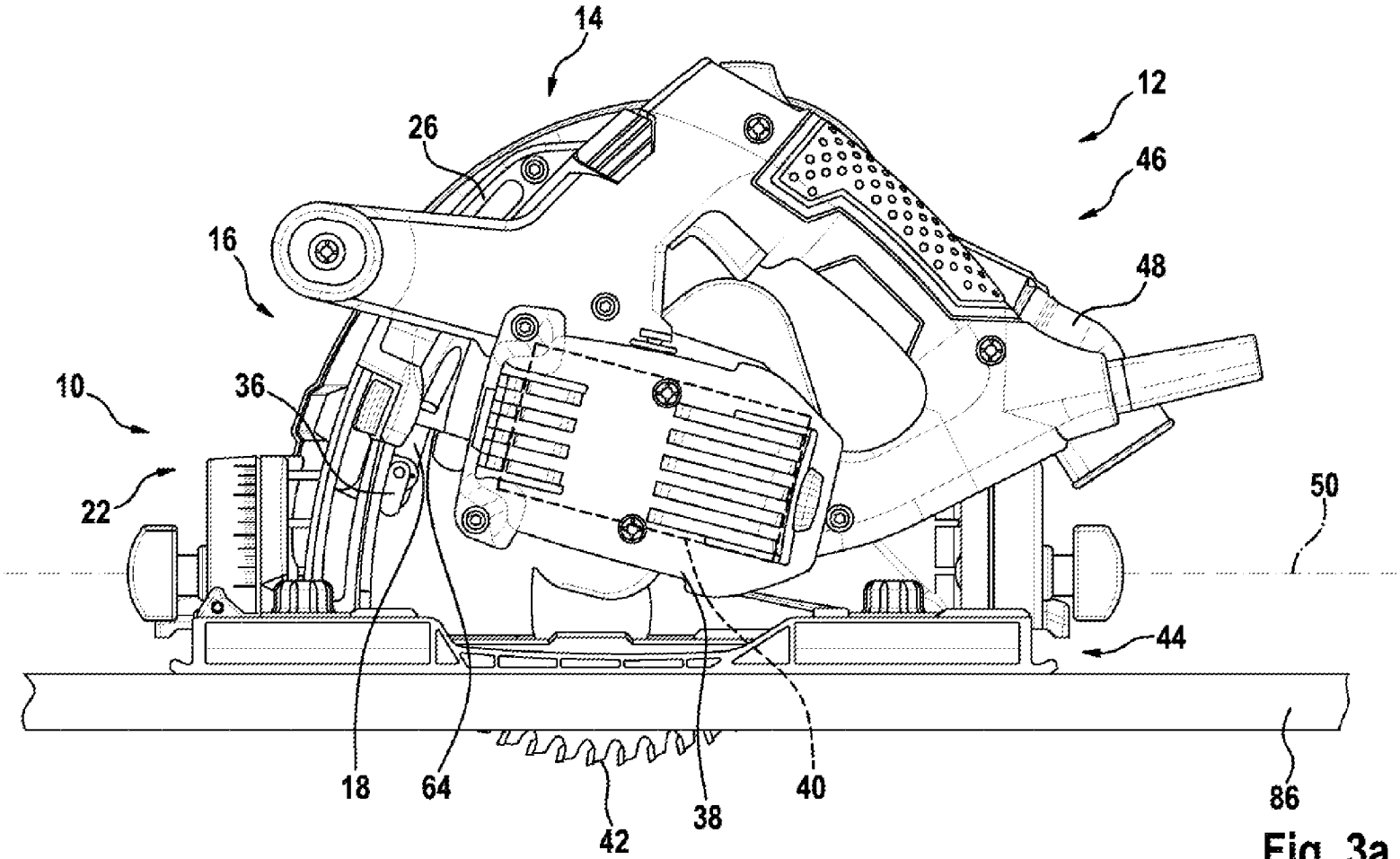
FIG. 3*a* shows a schematic representation of a side view of the portable power tool according to the disclosure while work is being performed on a workpiece, wherein a power-tool stop region bears against a stop element of a stop unit of the cut-depth limiting device according to the disclosure, which stop element is in a workpiece position.
Figure 3B:
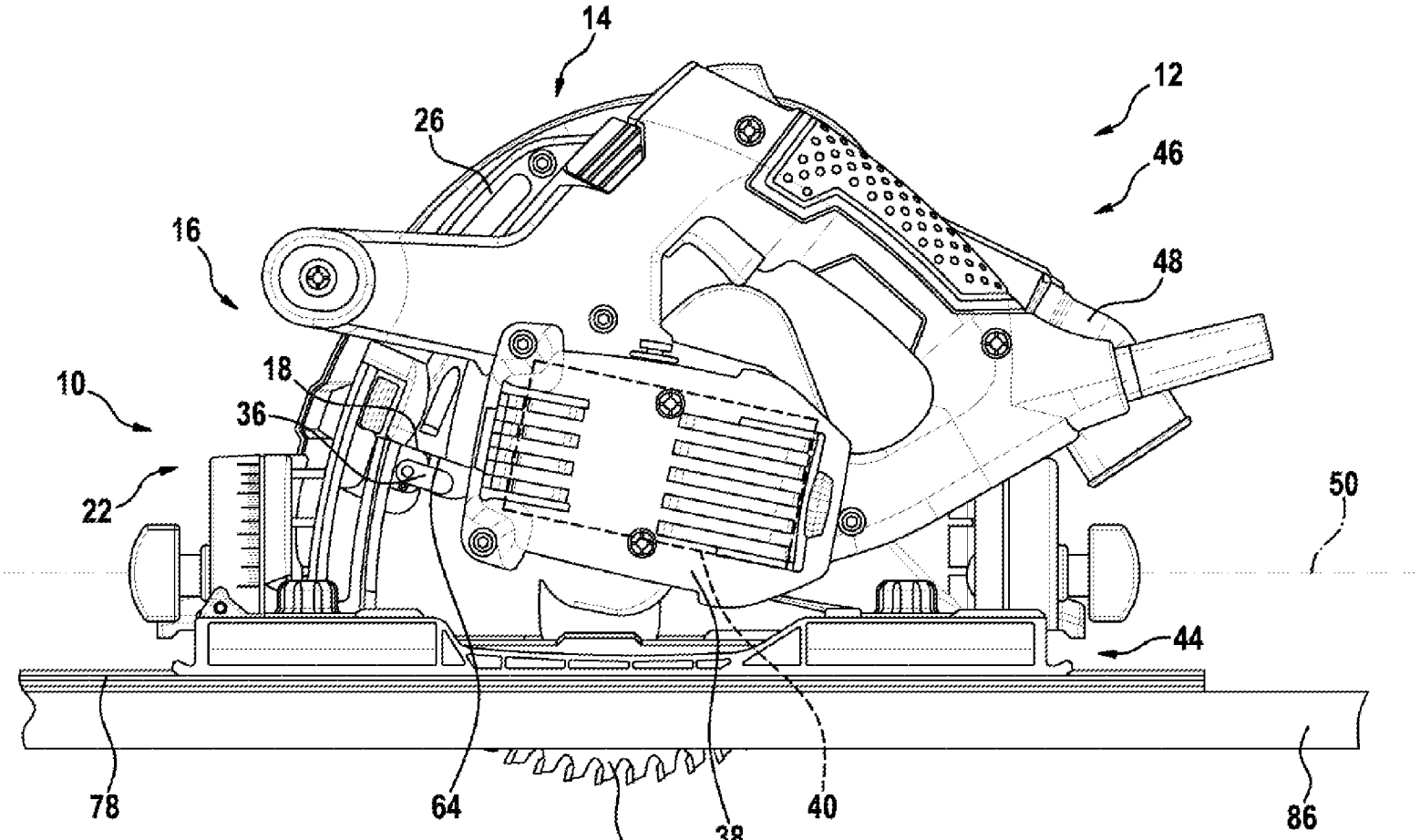
FIG. 3*b* shows a schematic representation of a side view of the portable power tool according to the disclosure, while work is being performed on a workpiece, with a constraining guide unit coupled to the portable power tool according to the invention disclosure, wherein the power-tool stop region bears against the stop element, which is in a constraining guide unit position.

FIG. 1 shows a portable power tool 12, realized as a plunge-cut saw, which comprises a cut-depth limiting device 10. The portable power tool 12 additionally comprises a power tool housing 38, which is provided to enclose a drive unit 40 of the portable power tool 12. The drive unit 40 comprises a drive shaft (not represented in greater detail here) for driving a working tool 42 (FIGS. 3*a* and 3*b*), which can be coupled to a tool receiver (not represented in greater detail here) of the portable power tool 12, in a manner already known to persons skilled in the art. The portable power tool 12 additionally comprises a seating unit 44, realized as a base plate or slide pad, by means of which the portable power tool 12, when performing work on a workpiece 86 (FIG. 3*a*), is seated on a workpiece surface of the workpiece 86, or slides on the workpiece surface during a movement to make a cut in the workpiece 86. Additionally disposed on the seating unit 44 is a safety unit 46 of the portable power tool 12, which protects an operator against injury when performing work n the workpiece 86. In this case, the safety unit 46 is realized as a safety hood, which surrounds the working tool 42, when mounted, by more than 160° along a rotational direction of the drive shaft. The safety unit 46 additionally has a suction coupling element 48, which can be connected to a suction unit (not represented in greater detail here) for extracting removed workpiece particles by suction as work is being performed on the workpiece 86. The power tool housing 38 is mounted on the safety unit 46 so as to be pivotable relative to the seating unit 44. In this case, the power tool housing 38 is mounted on the safety unit 46 so as to be pivotable about two pivot axes 50, 52, relative to the seating unit 44, in a manner already known to persons skilled in the art. The two pivot axes 50, 52 extend at least substantially perpendicularly relative to each other. In this case, the safety unit 46, together with the power tool housing 38, is mounted on the seating unit 44 so as to be pivotable about the pivot axis 50, relative to the seating unit 44. The portable power tool 12 is thus of a design that is at least substantially already known to persons skilled in the art.

Figure 2:
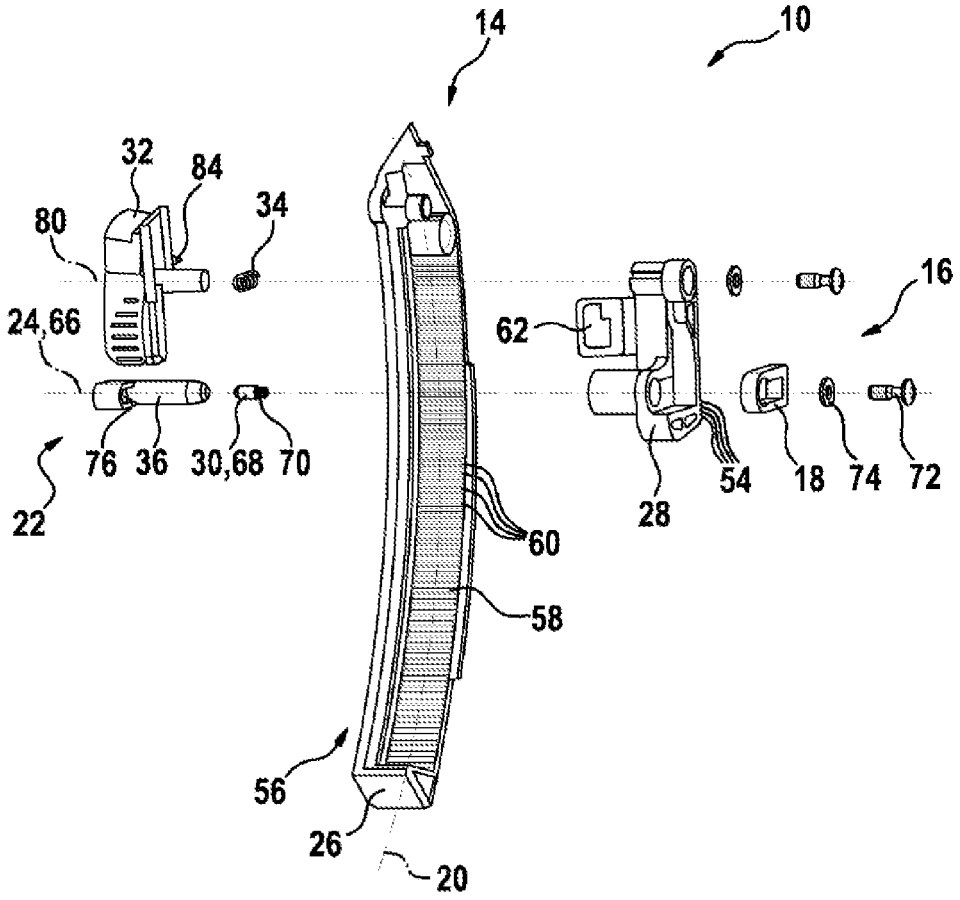
FIG. 2 shows a schematic, exploded representation of the cut-depth limiting device according to the disclosure when demounted from the portable power tool.

The cut-depth limiting device 10 for the portable power tool 12 is disposed on the safety unit 46, on a side of the safety unit 46 that faces toward the power tool housing 38, for the purpose of setting a limitation of a depth of cut. It is also conceivable, however, for the cut-depth limiting device 10 to be disposed at a different position on the safety unit 46, considered appropriate by persons skilled in the art, or on a different component of the portable power tool 12. The cut-depth limiting device 10 comprises at least one cut-depth guide unit 14 and at least one stop unit 16, which has at least one stop element 18 that, for the purpose of limiting a depth of cut, has a capability to move relative to the cut-depth guide unit 14 along a cut-depth guide path 20 of the cut-depth guide unit 14 (FIG. 2). In this case, for the purpose of setting a limitation of a depth of cut of the working tool 42, the stop element 18 is mounted so as to be translationally movable along the cut-depth guide path 20. By means of a cut-depth guide element 28 of the cut-depth guide unit 14, the stop element 18 is mounted on a guide rail element 26 of the cut-depth guide unit 14 so as to be movable along the cut-depth guide path 20. In this case, the stop element 18 is mounted on the cut-depth guide element 28 so as to be movable relative to the cut-depth guide element 28. The cut-depth guide unit 14 thus comprises at least the cut-depth guide element 28, which is mounted so as to be movable relative to the guide rail element 26 of the cut-depth guide unit 14, and on which the stop element 18 is mounted so as to be movable relative to the cut-depth guide element 28.

The cut-depth guide unit 14 has at least one further cut-depth guide element 32, which is mounted so as to be movable relative to the guide rail element 26, and on which the cut-depth guide element 28, provided for mounting the stop element 18, is movably mounted. The further cut-depth guide element 32 is realized as a guide block element that, by means of a form-closure connection to a form-closure region 56 of the guide rail element 26 (FIG. 2), is mounted on the guide rail element 26 so as to be movable along the cut-depth guide path 20. For the purpose of producing a latched connection in order to fix a position of the cut-depth guide element 28 and of the further cut-depth guide element 32 relative to the guide rail element 26, the cut-depth guide element 28, provided for mounting the stop element 18, is mounted on the further cut-depth guide element 32 so as to pivotable about a pivot axis 80 that runs at least substantially perpendicularly in relation to the cut-depth guide path 20. The cut-depth guide element 28 is thus realized as a cut-depth latching element, which has at least one integrally formed-on latching element 54. It is also conceivable, however, for the latching element 54 to be separate from the cut-depth guide element 28, and to be fixedly connected to the cut-depth guide element 28 by means of a type of connection considered appropriate by persons skilled in the art, such as, for example, by means of a form-closure and/or force-closure connection. The latching element 54 is realized as a latching lug, which has a polygonal cross section. The cut-depth guide element 28 has a total of four latching elements 54, which are integrally formed on to the cut-depth guide element 28 and parallel to each other. It is also conceivable, however, for a number other than four latching elements 54 to be integrally formed on to the cut-depth guide element 28.

For the purpose of producing a latched connection to the cut-depth guide element 28, realized as a cut-depth latching element, the guide rail element 26 has a latching rail 58. For the purpose of forming a latched connection to the cut-depth guide element 28, realized as with a cut-depth latching element, the latching rail 58 has counter-latching elements 60, which are realized to correspond with the latching elements 54 of the cut-depth guide element 28. On a side of the guide rail element 26 that faces away from the latching rail 58, the guide rail element 26 has a measurement scale 82, which acts in combination with a pointer element 84 disposed on the further cut-depth guide element 32, for the purpose of indicating a cut depth dimension that corresponds to a cut depth limitation set by means of the stop unit 16. It is also conceivable, however, for the cut-depth limiting device 10 to comprise a digital display for displaying a cut depth dimension that corresponds to a set limitation of a depth of cut.

The cut-depth guide unit 14 additionally has at least one spring element 34, which is provided to apply a spring force to the cut-depth guide element 28 in the direction of the guide rail element 26. This results in engagement of the latching elements 54 and counter-latching elements 60 when the cut-depth guide element 28 is in a non-actuated state. For the purpose of releasing the latched connection between the latching elements 54 and counter-latching elements 60, the cut-depth guide element 28 has an actuating region 62. An actuation of the actuating region 62 causes the cut-depth guide element 28 to be pivoted about the pivot axis 80, relative to the further cut-depth guide element 32. This causes the latching elements 54 and counter-latching elements 60 to be become disengaged. The further cut-depth guide element 32, realized as a guide block element, can thus be displaced, together with the cut-depth guide element 28, realized as a cut-depth latching element, along the cut-depth guide path 20, relative to the guide rail element 26. Since the stop element 18 is disposed on the cut-depth guide element 28, the stop element 18 is then likewise displaced along the cut-depth guide path 20, relative to the guide rail element 26. As a result of this, a limitation of a depth of cut of the working tool 42 is set. The cut-depth guide element 28 and the further cut-depth guide element 32 thus constitute a part of the stop unit 16. When work is being performed on the workpiece 86 by means of the working tool 42, upon a pivot movement of the power tool housing 38 relative to the safety unit 46, for the purpose of making a cut in the workpiece 86, or removing workpiece particles of the workpiece 86, a stop region 64 of the power tool housing 38 strikes against the stop element 18 when a depth of cut, set by means of the stop unit 16, has been reached.

The cut-depth limiting device 10 additionally comprises at least one stop movement unit 22, which is provided to allow a further capability of the stop element 18 to move relative to the cut-depth guide unit 14, along and/or about a movement axis 24, at least when in an operating state. The stop movement unit 22 is provided to allow a further capability of the stop element 18 to move relative to the cut-depth guide unit 14, at least when the latching elements 54 of the cut-depth guide element 28 have been latched in the counter-latching elements 60 of the guide rail element 26. The stop movement unit 22 is thus provided to allow a further capability of the stop element 18 to move relative to the cut-depth guide element 28, by means of the cut-depth guide element 28 realized as a cut-depth latching element, at least when the further cut-depth guide element 32, realized as a guide block element, is in a fixed position.

The stop element 18 is mounted on the cut-depth guide element 28 so as to be pivotable about the movement axis 24, realized as a stop pivot axis 66, relative to the cut-depth guide element 28. The stop pivot axis 66 runs at least substantially perpendicularly in relation to a course of the cut-depth guide path 20. In addition, the stop pivot axis 66 runs at least substantially parallelwise in relation to the pivot axis 80, about which the mounted cut-depth guide element 28 can be pivoted relative to the further cut-depth guide element 32. It is also conceivable, however, for the stop pivot axis 66 to have a different course, considered appropriate by persons skilled in the art, such as, for example, a course running parallelwise in relation to the cut-depth guide path 20 or transversely in relation to the cut-depth guide path 20, etc.

Figure 4A:
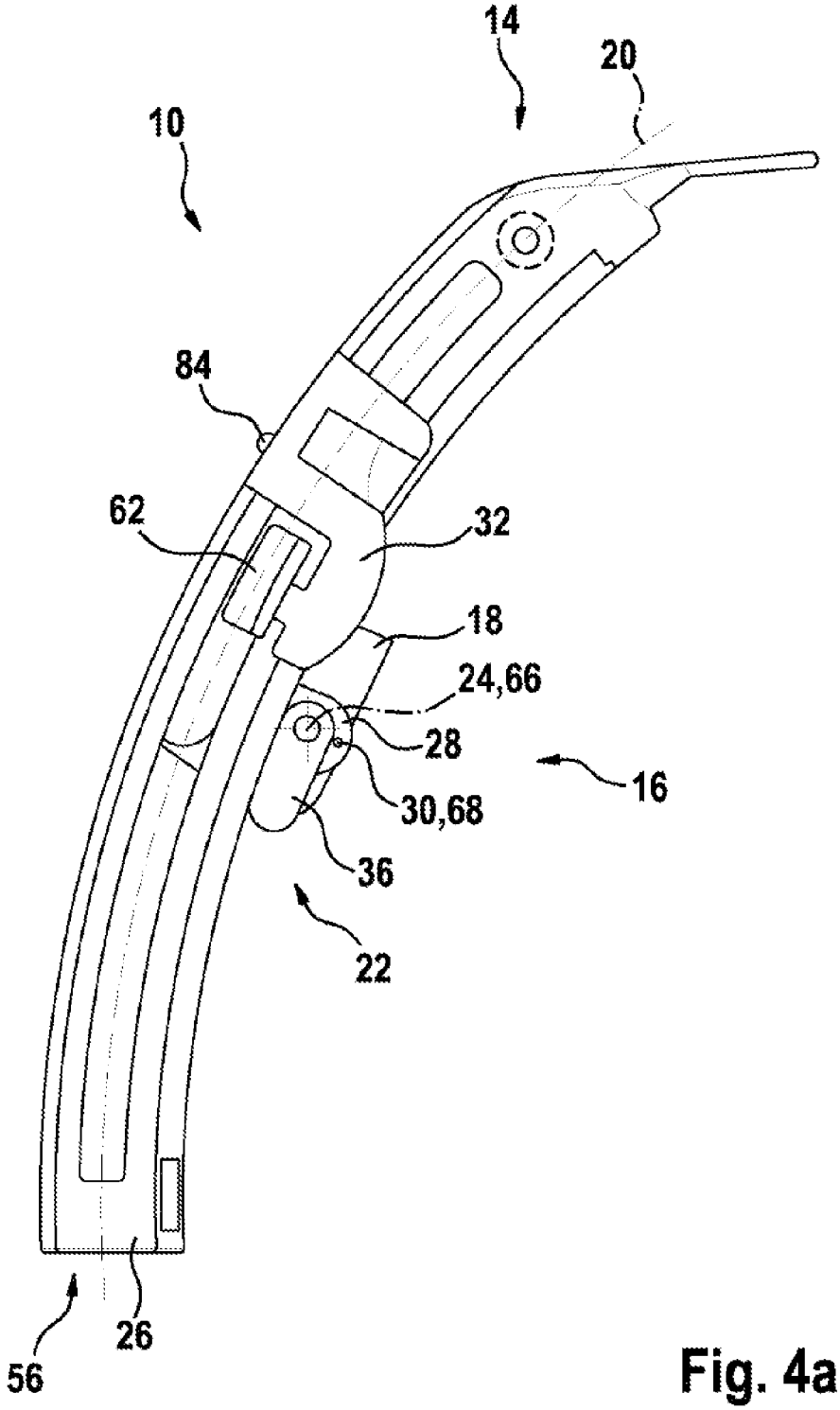
FIG. 4*a* shows a schematic representation of a detail view of the cut-depth limiting device according to the disclosure, with the stop element in a workpiece position.
Figure 4B:
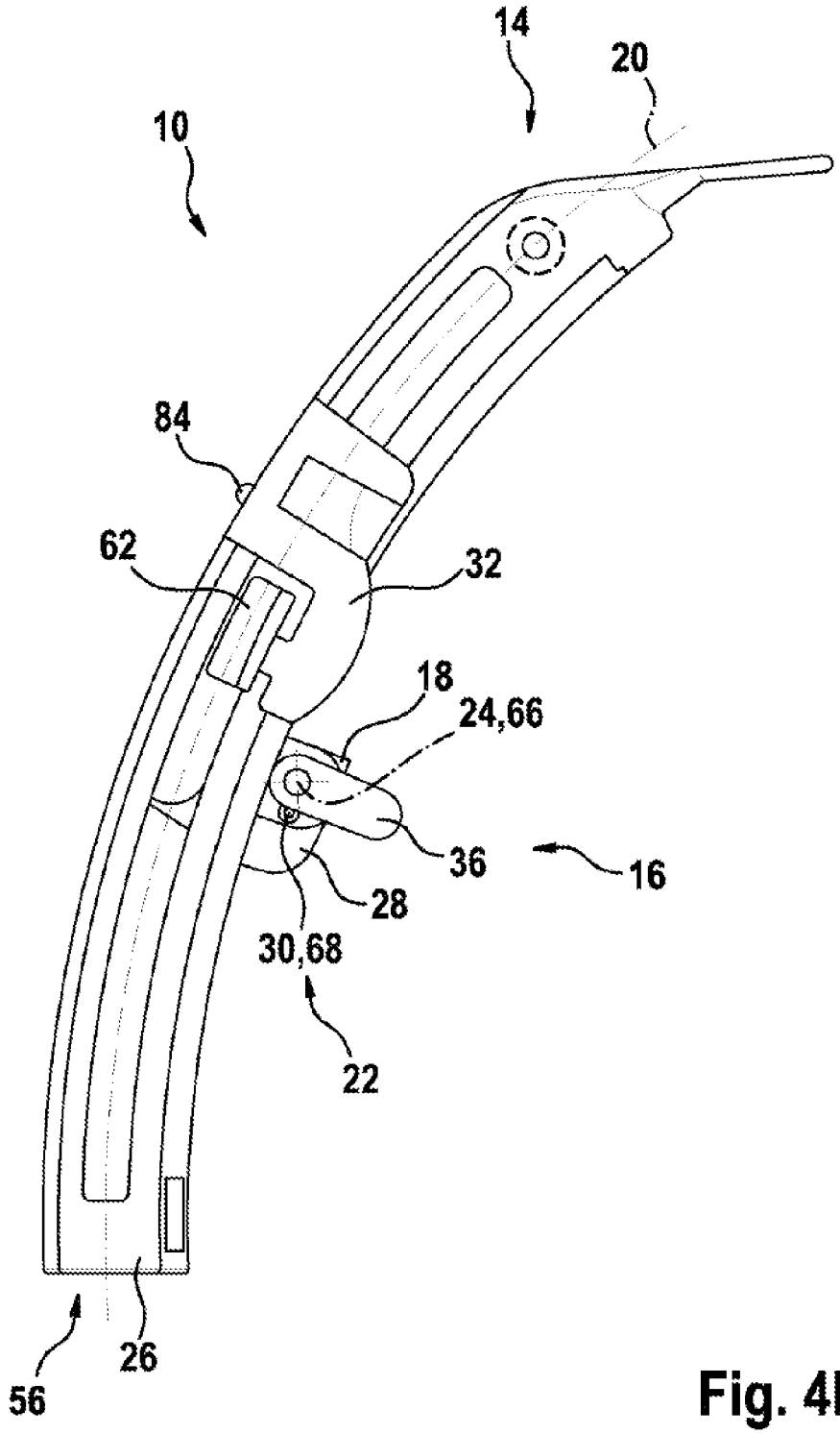
FIG. 4*b* shows a schematic representation of a detail view of the cut-depth limiting device according to the disclosure, with the stop element in a constraining guide unit position.

The stop movement unit 22 comprises at least one position fixing element 30, which is provided to fix the stop element 18 in a position relative to the cut-depth guide element 28. The position fixing element 30 is realized as a latching pin 68, which is biased with a spring force by means of a position fixing spring element 70 of the stop movement unit 22. The stop movement unit 22 has a total of two position fixing elements 30, which are each assigned to a position of the stop element 18 relative to the cut-depth guide element 28. For the purpose of moving the stop element 18, the stop movement unit 22 has at least one stop movement element 36, which is realized as an operating lever, and which is mounted on the cut-depth guide element 28 of the cut-depth guide unit 14 so as to be pivotable about the movement axis 24. The stop element and the stop movement element 36 are fixedly connected to each other. In this case, the stop element 18 is fixedly connected to the stop movement element 36 by means of a screwed connection, which comprises a screw 72, which can be screwed into the stop movement element 36, and a washer 74. The stop element 18 is thus motionally dependent on a movement of the stop movement element 36. The stop movement element 36 has a latching recess 76, in which one of the two positioning fixing elements 30 engages for the purpose of fixing a position of the stop movement element 36, and thus of the stop element 18, in dependence on a position of the stop movement element 36, and thus of the stop element 18, relative to the cut-depth guide element 28. The two position fixing elements 30 are disposed on the cut-depth guide element 28, offset relative to each other by approximately 90° (FIGS. 4*a* and 4*b*). In this case, a spring force of one of two position fixing spring elements 70 of the stop movement unit 22 acts, respectively, upon each of the position fixing elements 30, realized as latching pins 68, in the direction of the stop movement element 36.

Thus, after a limitation of a depth of cut has been set, the stop element 18 can additionally be moved, about the movement axis 24 realized as a stop pivot axis 66, from a workpiece position (FIGS. 3*a* and 4*a*) of the stop element 18 to a constraining guide unit position of the stop element 18 (FIGS. 3*b* and 4*b*), by means of the stop movement unit 22. The stop element 18 and the stop movement element 36 are mounted on the cut-depth guide element 28 such that they are each pivotable about the movement axis 24, realized as a stop pivot axis 66, relative to the cut-depth guide element 28 by an angle of 90°, starting from the workpiece position or the constraining guide position of the stop element 18. When the stop element 18 is in the workpiece position, a first stop surface of the stop element 18 therefore constitutes a limiting surface, against which the stop region 64 of the power tool housing 38 can strike, upon a pivot movement relative to the safety unit 46 about the pivot axis 52, for the purpose of limiting a depth of cut. When the stop element 18 is in the constraining guide unit position, a second stop surface of the stop element 18, which is offset at least substantially by 90° in relation to the first stop surface of the stop element 18, constitutes a further limiting surface against which the stop region 64 of the power tool housing 38 can strike, upon a pivot movement about the pivot axis 52, relative to the safety unit 46, for the purpose of limiting a depth of cut in the case of use of a constraining guide unit 78 of a power tool system comprising the portable power tool 12, while work is being performed on the workpiece 86.

As a result of this, for example in the case of use of the constraining guide unit 78 (FIG. 3*b*) of the power tool system, a previously set limitation of a depth of cut, with the stop element 18 in the workpiece position, can be adapted to a height of the constraining guide unit 78. In the case of a previously set depth of cut, changing the stop element 18 over from the workpiece position to the constraining guide position, while work is being performed on the workpiece 86, has the effect that, when the stop element 18 is in the constraining guide position, in the case of use of the constraining guide unit 78, the working tool 42 penetrates into, or comes out of, the workpiece 86 to the same extent as when the stop element 18 is in the workpiece position, disassociated from use of the constraining guide unit 78. In this case, the constraining guide unit 78 is realized as a guide rail, which can be disposed on the workpiece 86. The constraining guide unit 78 realized as a guide rail is provided to guide the portable power tool 12 along at least one direction. A movement of the stop element 18 relative to the cut-depth guide element 28 realized as a cut-depth latching element, from the workpiece position to the constraining guide unit position, in the case of use of a constraining guide unit 78, while work is performed on the workpiece 86 by means of the portable power tool 12, compensates a height of the constraining guide unit 78. Thus, whether it is selected to perform work on the workpiece 86 with use of the constraining guide unit 78, or it is selected to perform work on the workpiece 86 without use of the constraining guide unit 78, there is no need for readjustment of a setting of a limitation of the depth of cut by means of a movement of the cut-depth guide element 28 and of the further cut-depth guide element 32 for the purpose of displacing the stop element 18 along the cut-depth guide path 20, relative to the guide rail element 26. A pivot movement of the stop element 18 about the movement axis 24 realized as a stop pivot axis 66, relative to the fixed cut-depth guide element 28, starting from the workpiece position of the stop element 18, is thus provided to adapt a limitation of a depth of cut, set with the stop element 18 in the workpiece position, in the case of use of the constraining guide unit 78, while work is performed on the workpiece 86, to a height of the constraining guide unit 78. The stop region 64 of the power tool housing 38 strikes when the stop element 18 is in the workpiece position, with the position of the cut-depth guide element 28 relative to the guide rail element 26 remaining the same, for the purpose of fixedly setting a limitation of a depth of cut, as compared with striking of the stop region 64 of the power tool housing 38 after a relatively short distance, along which the power tool housing 38 is pivoted about the pivot axis 52 relative to the safety unit 46 for the purpose of making a cut by means of the working tool 42, when the stop element 18 is in the constraining guide unit position.

The invention claimed is:

1. A cut-depth limiting device for portable power tools, comprising:

at least one cut-depth guide unit defining a cut-depth guide path;

at least one cut-depth guide element mounted on the at least one cut-depth guide unit to be movable along the cut-depth guide path;

at least one stop movement unit mounted on the at least one cut-depth guide element to be movable relative to the at least one cut-depth guide element by at least one of translation along and rotation about a movement axis; and at least one stop unit including at least one stop element mounted on the at least one stop movement unit such that:

movement of the at least one cut-depth guide element along the cut-depth guide path enables a first movement of a position of the at least one stop element relative to the at least one cut-depth guide unit; and movement of the at least one stop movement unit relative to the at least one cut-depth guide element enables a second movement of the position of the at least one stop element relative to the at least one cut-depth guide unit independent from the first movement;

a position of the at least one stop element relative to the at least one cut-depth guide unit defining a limit for a depth of cut of a portable power tool.

2. The cut-depth limiting device as claimed in claim 1, wherein the at least one cut-depth guide unit includes a guide rail element, the at least one cut-depth guide element mounted to the at least one cut-depth guide unit via the guide rail element.

3. The cut-depth limiting device as claimed in claim 2, wherein the at least one stop movement unit has at least one position fixing element, which is configured to fix the at least one stop element in a position relative to the at least one cut-depth guide element.

4. The cut-depth limiting device as claimed in claim 2, wherein the at least one cut-depth guide unit has at least one further cut-depth guide element, which is mounted so as to be movable relative to the guide rail element and on which the at least one cut-depth guide element is movably mounted.

5. The cut-depth limiting device at least in claim 2, wherein the at least one cut-depth guide unit has at least one spring element, which is configured to apply a spring force to the at least one cut-depth guide element in a direction of the guide rail element.

6. The cut-depth limiting device as claimed in claim 1, wherein the at least one stop movement unit has at least one stop movement element, the at least one stop movement element being an operating lever that is pivotable about the movement axis to actuate the second movement of the at least one stop element.

7. The cut-depth limiting device as claimed in claim 6, wherein the at least one stop element and the at least one stop movement element are fixedly connected to each other.

8. The cut-depth limiting device as claimed in claim 1, wherein the movement axis runs at least substantially perpendicularly in relation to a course of the cut-depth guide path.

9. The cut-depth limiting device as claimed in claim 1, wherein the movement of the at least one stop movement unit relative to the at least one cut-depth guide element is at least a pivoting movement about the movement axis.

10. A portable power tool, comprising:

at least one cut-depth limiting device that includes:

at least one cut-depth guide unit defining a cut-depth guide path;

at least one cut-depth guide element mounted on the at least one cut-depth guide unit to be movable along the cut-depth guide path;

at least one stop movement unit mounted on the at least one cut-depth guide element to be movable relative to the at least one cut-depth guide element by at least one of translation along and rotation about a movement axis; and at least one stop unit including at least one stop element mounted on the at least one stop movement unit such that:

movement of the at least one cut-depth guide element along the cut-depth guide path enables a first movement of a position of the at least one stop element relative to the at least one cut-depth guide unit; and movement of the at least one stop movement unit relative to the at least one cut-depth guide element enables a second movement of the position of the at least one stop element relative to the at least one cut-depth guide unit independent from the first movement;

a position of the at least one stop element relative to the at least one cut-depth guide unit defining a limit for a depth of cut of a portable power tool.

* * * * *